US010472163B2

(12) United States Patent
Shimizu et al.

(10) Patent No.: US 10,472,163 B2
(45) Date of Patent: Nov. 12, 2019

(54) FIXING PLATE FOR AEROSOL CONTAINER

(71) Applicant: TOYO AEROSOL INDUSTRY CO., LTD., Tokyo (JP)

(72) Inventors: Hirokazu Shimizu, Tokyo (JP); Nobuyuki Hanai, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 75 days.

(21) Appl. No.: 15/953,735

(22) Filed: Apr. 16, 2018

(65) Prior Publication Data

US 2018/0229921 A1 Aug. 16, 2018

Related U.S. Application Data

(63) Continuation of application No. PCT/JP2016/051250, filed on Jan. 18, 2016.

(51) Int. Cl.
*B65D 83/68* (2006.01)
*B65D 83/20* (2006.01)
(Continued)

(52) U.S. Cl.
CPC ..... *B65D 83/68* (2013.01); *B65D 83/205* (2013.01); *B65D 83/682* (2013.01);
(Continued)

(58) Field of Classification Search
CPC .... B65D 83/68; B65D 83/205; B65D 83/682; B65D 83/753; B65D 83/38; B65D 83/48
See application file for complete search history.

(56) References Cited

U.S. PATENT DOCUMENTS 5,027,982 A 7/1991 Demarest
2005/0127094 A1* 6/2005 Decottignies ..... B05B 11/0078 222/94
(Continued)

FOREIGN PATENT DOCUMENTS

EP 1000874 A2 5/2000
JP 11-278554 A 10/1999
(Continued)

OTHER PUBLICATIONS

International Search Report dated Apr. 12, 2016, issued in Counterpart of International Application No. PCT/JP2016/051250 (2 pages).

*Primary Examiner* — Jeremy Carroll
(74) *Attorney, Agent, or Firm* — Westerman, Hattori, Daniels & Adrian, LLP

(57) ABSTRACT

To provide a fixing plate for an aerosol container that allows positioning thereof, fittable to a mounting cup, applicable to aerosol containers without changes in shape, and fittable to the mounting cup without displacing out of position relative to the mounting cup. The fixing plate (100) for an aerosol container is mounted to a mounting cup (310) having two stems (320) protruding therefrom and is used for positioning of an exterior component. The fixing plate is formed in a cylindrical shape fittable to the mounting cup (310), includes, on an inner circumferential side thereof, container positioning unit and container lock unit for positioning and retaining and fitting of the fixing plate (100) and the mounting cup (310), and includes, on an outer circumferential side thereof, exterior component positioning unit and exterior component lock unit for positioning and retaining and fitting of the fixing plate (100) and the exterior component (200).

7 Claims, 8 Drawing Sheets

(51) Int. Cl.

| | |
|---|---|
| ***B65D 83/14*** | (2006.01) |
| *B65D 83/38* | (2006.01) |
| *B65D 83/40* | (2006.01) |

(52) U.S. Cl.
CPC ..... *B65D 83/753* (2013.01); *B65D 83/38* (2013.01); *B65D 83/40* (2013.01)

(56) References Cited

U.S. PATENT DOCUMENTS

| | | | | |
|---|---|---|---|---|
| 2012/0168463 | A1* | 7/2012 | Hanai | B65D 83/62 222/135 |
| 2013/0112707 | A1* | 5/2013 | Hanai | B65D 83/68 222/94 |
| 2013/0119088 | A1* | 5/2013 | Hanai | B65D 83/34 222/135 |
| 2014/0361037 | A1 | 12/2014 | Green | |
| 2015/0251202 | A1 | 9/2015 | Ogata et al. | |
| 2016/0075500 | A1 | 3/2016 | Ogata et al. | |

FOREIGN PATENT DOCUMENTS

| | | | |
|---|---|---|---|
| JP | 2015-209268 | A | 11/2015 |
| WO | 2014/192621 | A1 | 12/2014 |

* cited by examiner

Step 3(E-E' cross-sectional view)

Step 3(F-F' cross-sectional view)

FIXING PLATE FOR AEROSOL CONTAINER

TECHNICAL FIELD

The present invention relates to a fixing plate for an aerosol container, which is mounted to a mounting cup that is fitted on the aerosol container, and with which an exterior component is engaged, and more particularly to a fixing plate mounted to a mounting cup that has an irregular-shaped upper step with two stems protruding therefrom and a cylindrical middle step.

BACKGROUND ART

As one type of existing aerosol containers that contain two-liquid type hair dying or hair styling products or the like, a dual compartment aerosol container, which is formed of a pair of first and second cylindrical containers, respectively containing a first content and a second content and arranged side by side, is known.

Such a dual compartment aerosol container is provided with a nozzle for dispensing the contents discharged from the stems of respective containers from one discharge tube. In addition, it is common to provide a shoulder cover that covers the mounting cup of the container in order to hold both containers together, or to enhance the decorative effect, for example. With the use of a shoulder cover that has an oval outer shape corresponding to the oval cross-sectional shape of the dual compartment aerosol container as a whole, the cover can be readily set in position only by checking its orientation in the front to back direction relative to the container.

The trend in recent years with such two-liquid type aerosol containers is the increasing use of aerosol containers separately containing two types of contents in one container and having two stems.

While containers of this type have a circular cross-sectional shape as a whole, the two stems are disposed side by side in an irregular-shaped part that is provided to the mounting cup and has a cross sectional shape with long sides and short sides. Therefore, the shoulder cover needs to be oriented correspondingly so as not to interfere with the two stems when mounted to the container.

For example, as shown in Patent Literature 1, the shoulder cover having a similar outer shape as that of the container includes, on the inner side, oppositely arranged anti-rotation ribs to abut with the long side surfaces of an irregular-shaped part of the mounting cup, and inner walls to abut with the short side surfaces of the irregular-shaped part.

Thus, when the shoulder cover is placed on the mounting cup and rotated with a light force, the shoulder cover fits deeply with the mounting cup at the position where the irregular-shaped part is locked in the gaps between the anti-rotation ribs. As the shoulder cover is pressed further down, a convex portion provided to the shoulder cover fits with a lower step of the mounting cup to retain the cover. Thus the shoulder cover is readily set in position relative to the container only by checking its front-to-back direction.

Further, a fixing plate that has an outer shape similar to that of the container, and is provided with oppositely arranged anti-rotation ribs that abut the long side surfaces of the irregular-shaped part of the mounting cup and inner walls that abut the short side surfaces of the irregular-shaped part, is fitted to the mounting cup. This allows free selection of exterior components and the like, which have convex portions that fit in slits of the fixing plate.

The provision of the fixing plate, which is a separate component, as the part fitted with the aerosol container facilitates molding of exterior components, and increases the degree of freedom in the shapes of exterior components.

CITATION LIST

Patent Literature

Patent Literature 1: WO2014/192621

SUMMARY OF INVENTION

Technical Problem

In order to be retained and fitted to the mounting cup while covering the outermost part of the mounting cup, these known shoulder cover and fixing plate have components with a sufficient thickness to ensure their strength, which extend out on the outermost part of the mounting cup. Therefore, when the can body of the aerosol container has the same diameter as that of the outermost part of the mounting cup, the fixing plate may extend out much more than the can body, which leads to inefficiency in production such as the aerosol product being prone to easily lose balance and fall over, or the number of packages per unit volume being reduced.

Another problem was that the exterior component design is limited to shapes that cover the entire mounting cup, and when an exterior component needs to be attached to only part of the mounting cup, such need could not be met.

For aerosol containers having a larger diameter than that of the outermost part of the mounting cup, since the fixing plate has an outer shape similar to that of the aerosol container, a new fixing plate needs to be prepared every time the shape of the shoulder part or the can body diameter of the aerosol container is changed. This led to the problems of increased production cost and the necessity to keep a variety of fixing plates in stock.

Moreover, the anti-rotation ribs that are abutted to the long surfaces of the irregular-shaped part of the mounting cup protrude in a planar shape, so that there was a risk, for example, that the anti-rotation ribs may be bent when subjected to an excessive load when fitted to the mounting cup.

Furthermore, since the mounting cup and fixing plate have no parts that engage each other until the fixing plate is pushed down, there was a risk that the fixing plate could come off of the mounting plate due to vibration when the assembling operation is carried out on a conveyor, for example.

The present invention solves the problems described above, its object being to provide a fixing plate for an aerosol container, and an aerosol product, the fixing plate allowing easy positioning thereof, being capable of being retained and fitted to the mounting cup without extending out from the outermost part of the mounting cup, being applicable to aerosol containers of various can body diameters and shoulder shapes without changes in shape, and being fittable to the mounting cup without displacing out of position relative to the mounting cup.

Solution to Problem

The fixing plate for an aerosol container according to the present invention is a fixing plate for an aerosol container that is mounted to a mounting cup having an irregular-shaped upper step with two stems protruding therefrom and a cylindrical middle step, and is used for positioning of an exterior component, wherein the fixing plate is formed in a cylindrical shape fittable to the mounting cup, the fixing plate includes, on an inner circumferential side thereof, container positioning unit for engaging with a side surface of the upper step and determining a fitting position, and container lock unit for engaging with a portion below the cylindrical middle step to retain the fixing plate to the mounting cup, and the fixing plate includes, on an outer circumferential side thereof, exterior component positioning unit for engaging with an exterior component and determining a fitting position, and exterior component lock unit formed by a constricted portion for locking the exterior component, whereby the problems mentioned above are solved.

Advantageous Effects of Invention

According to the fixing plate for an aerosol container as set forth in claim 1, the fixing plate fittable to the mounting cup includes, on an inner circumferential side thereof, container positioning unit for engaging with a side surface of the upper step of the mounting cup and determining a position for the mounting cup and the fixing plate to fit with each other, so that easy positioning of the fixing plate is made possible, which is achieved by placing the fixing plate on the mounting cup and turning the fixing plate with a light force.

The fixing plate further includes, on an inner circumferential side thereof, container lock unit for engaging with a portion below the middle step of the mounting cup to retain the fixing plate to the mounting cup. Since the fixing plate makes contact with and fixed to only the middle step and the part thereabove of the mounting cup which is not affected by the container shape, the same fixing plate can be used for a variety of aerosol containers. Namely, a plurality of types of fixing plates need not be prepared in accordance with various can body diameters and shoulder shapes.

The fixing plate further includes, on an outer circumferential side thereof, exterior component positioning unit for engaging with an exterior component and determining a fitting position, so that the positional relationship between the fixing plate fitted to the mounting cup and the exterior component is not mistaken and the exterior component can always be fitted to a correct position.

The fixing plate further includes, on an outer circumferential side thereof, exterior component lock unit formed by a constricted portion for locking the exterior component. The exterior component can be retained and held on the fixing plate by pressing down the exterior component from above the fixing plate so that the convex portion provided on the inner circumferential surface of the exterior component reaches and fits into the constricted portion of the fixing plate.

According to the configuration set forth in claim 2, an upper part on the inner circumferential side of the fixing plate includes a positioning wall in a shape conforming to a side surface of the upper step of the mounting cup, so that, when the fixing plate is positioned and fitted to the mounting cup, they make contact with each other in a wide area, and hardly any local force can be created that may lead to breakage of the fixing plate.

According to the configuration set forth in claim 3, the container lock unit includes a middle concave portion below the cylindrical middle step of the mounting cup, and a retaining convex portion that is provided in a lower part on the inner circumferential side of the fixing plate and engages with the middle concave portion, whereby the fixing plate is retained and held to the mounting cup of the container. Therefore, even when a force acts on the fixing plate in a direction in which it is separated from the mounting cup, the fitting engagement between the fixing plate and the mounting cup is unlikely to loosen.

According to the configuration set forth in claim 4, the exterior component positioning unit is formed by a convex rib provided on the outer circumferential side of the fixing plate and extending vertically. The exterior component and the fixing plate are thus fitted to each other, with the positions of a downwardly open slit in the inner circumferential surface of the exterior component and the convex rib matched with each other, whereby reliable positioning of the fixing plate and exterior component is made possible.

According to the configuration set forth in claim 5, the exterior component lock unit includes a plurality of fitting constricted portions for retaining and holding the exterior component at a position where the exterior component is fitted. The convex portion on the inner circumferential surface of the exterior component can be fitted into one of the fitting constricted portions provided at a higher position so as to make fine adjustment of the fitting position between the exterior component and the fixing plate. Therefore, even when subjected, for example, to vibration that may occur depending on the ambient environment such as during assembling work on a conveyor, the exterior component will not fall off of the fixing plate, and thus the exterior component and fixing plate can be safely positioned and fitted to each other.

According to the configuration set forth in claim 6, the fixing plate has an outermost diameter smaller than a maximum diameter of the mounting cup. Even when the can body diameter is the same as the maximum diameter of the mounting cup, the fixing plate and exterior component can be formed so as not to extend beyond the can body diameter. Namely, it will be easier to keep good balance of the aerosol product as a whole, and there will be no decline in the number of packages per unit volume.

According to the configuration set forth in claim 7, the fixing plate for an aerosol container can be readily positioned and mounted to a middle step of a mounting cup provided to the aerosol container, as well as an exterior component can be readily positioned and engaged with the fixing plate for an aerosol container.

Since the exterior component is fitted to a portion below the mounting cup, the aerosol container and exterior component can be easily positioned with each other, and the exterior component and fixing plate can be retained and fitted to the mounting cup without extending out from the outermost part of the mounting cup. Moreover, the fixing plate is applicable to aerosol containers with various can body diameters and shoulder shapes. It is unlikely that the exterior component and fixing plate are displaced out of position when fitted to the mounting cup.

REFERENCE SIGNS LIST

Figure 1:
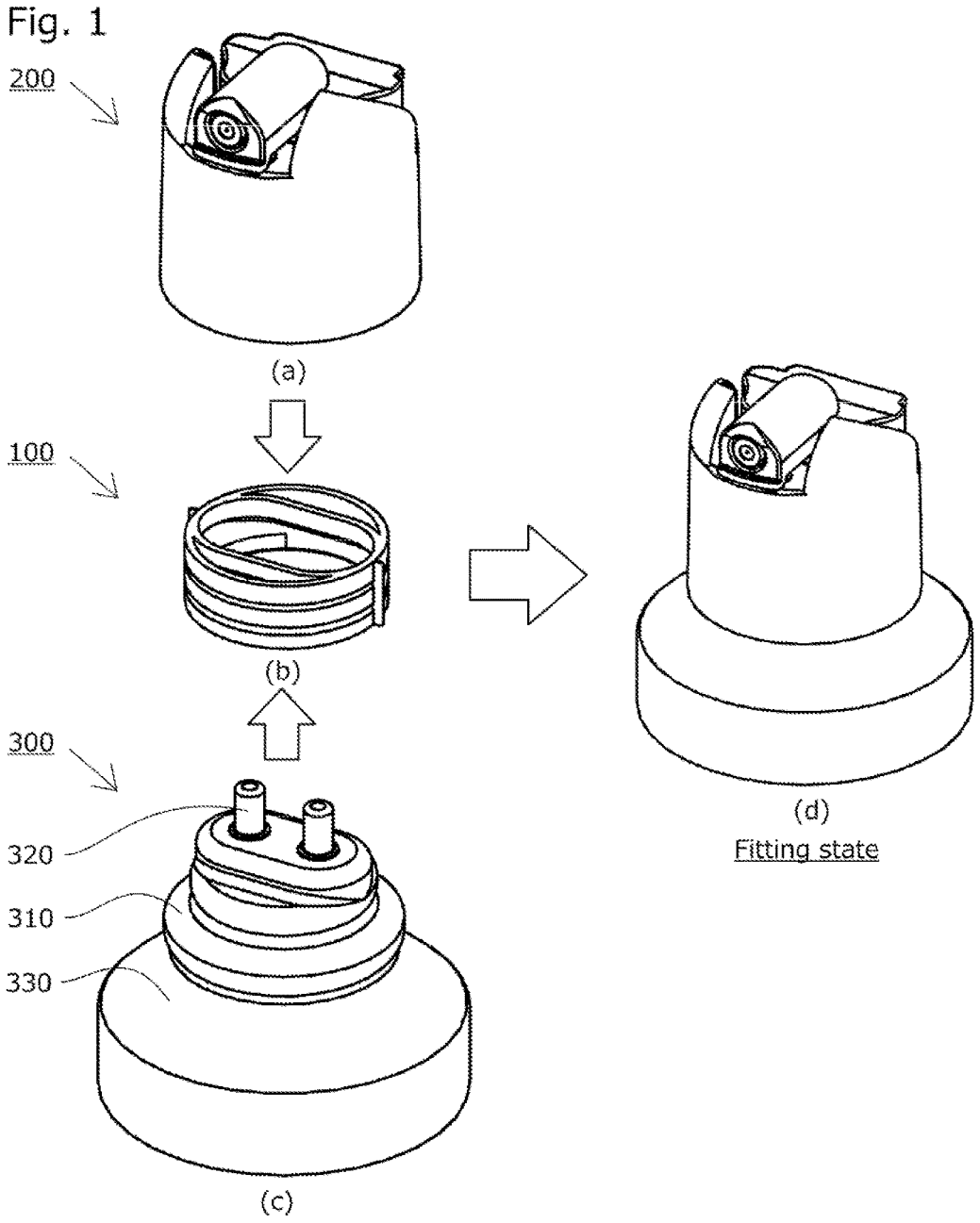
FIG. 1 is a perspective view of a fixing plate 100, an actuator 200, and an aerosol container 300, showing them separately and altogether when fitted to each other.

100 Fixing plate
110 Cylindrical main body
111 Positioning wall
112 Retaining convex portion
113 Anti-rotation rib
114 First constricted portion
115 Second constricted portion
200 Actuator
210 Actuator operation part
211 Stem fitting part
212 Ejection passage
213 Center post
214 Ejection port
215 Pressing part
220 Actuator fitting part
221 Cover
222 Hinge part
223 Fitting convex portion for connection with container
224 Engaging wall
225 Slit
226 Fitting convex portion for connection with fixing plate
300 Aerosol container
310 Mounting cup
311 Upper step top surface
312 Upper step side surface
313 Middle step top surface
314 Middle step side surface
315 Middle step constricted portion
316 Lower step top surface
317 Lower step side surface
318 Lower step constricted portion
320 Stem
330 Aerosol can
331 Shoulder part
332 Body part

DESCRIPTION OF EMBODIMENT

Hereinafter, a fixing plate 100 according to one embodiment of the present invention will be described with reference to the drawings.

Figure 2:
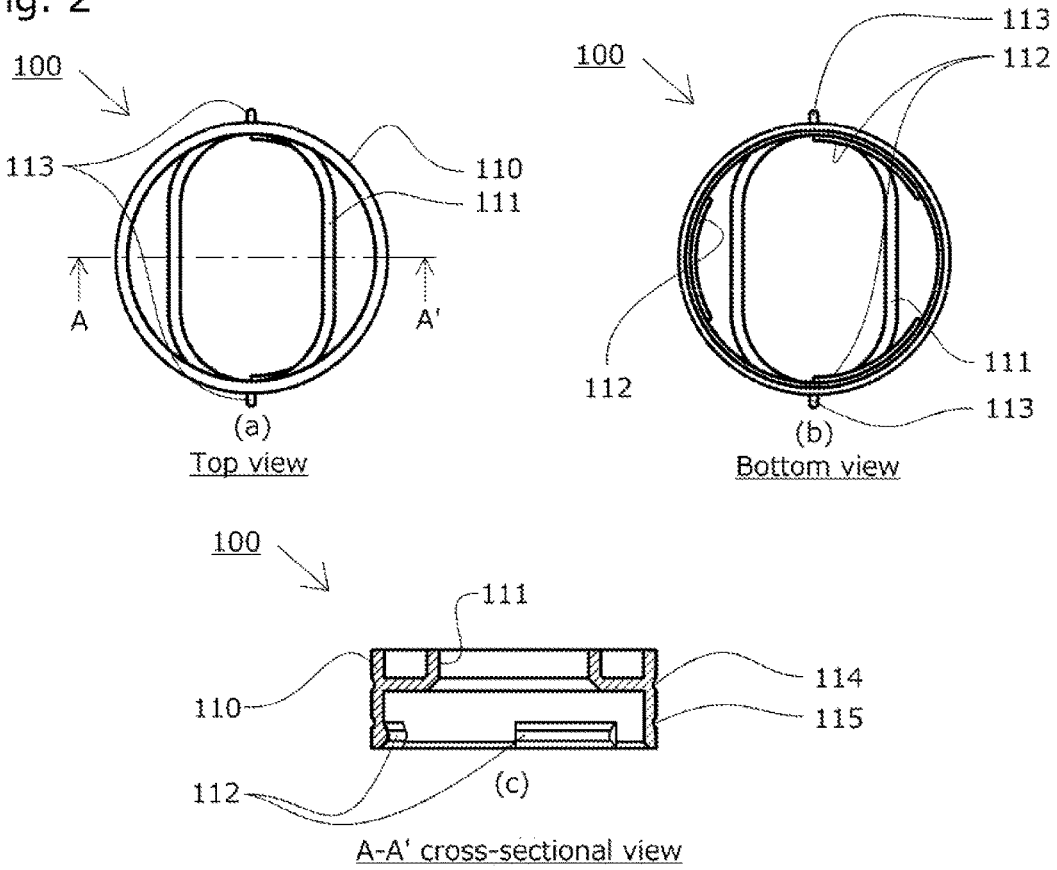
FIG. 2 shows a top view, a bottom view, and an A-A' cross-sectional view of the fixing plate 100.

The fixing plate 100 is mounted to a mounting cup 310 fitted on an aerosol can 330, and engaged with an exterior component such as an actuator 200. As shown in FIG. 1 and FIG. 2, the fixing plate includes a cylindrical main body 110. A positioning wall 111 is provided in an upper part on an inner circumferential surface of the cylindrical main body 110 such as to protrude inward of the cylindrical main body 110 and extending upwards. Retaining convex portions 112 protruding in a circular arc shape are provided in a lower part on the inner circumferential surface of the cylindrical main body 110.

A pair of anti-rotation ribs 113 extend vertically in a convex form on an outer circumferential surface of the cylindrical main body 110. A first constricted portion 114 and a second constricted portion 115 are formed on the outer circumferential surface of the cylindrical main body 110 such as to extend circumferentially except for the parts where the anti-rotation ribs 113 are provided.

Figure 3:
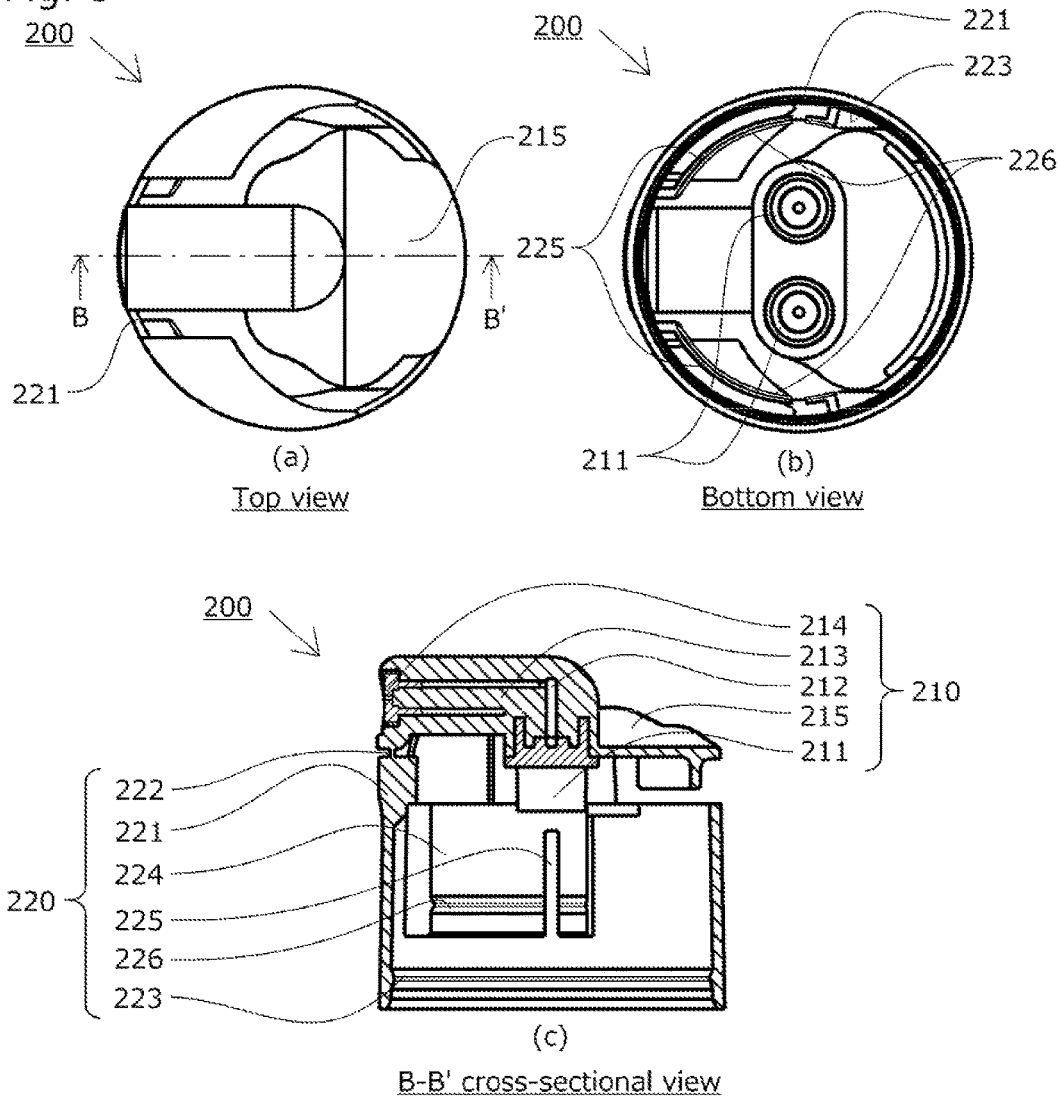
FIG. 3 shows a top view, a bottom view, and a B-B' cross-sectional view of the actuator 200.

The actuator 200 coupled to the fixing plate 100 is formed by an actuator operation part 210 and an actuator fitting part 220 as shown in FIG. 1 and FIG. 3. The actuator operation part 210 includes a stem fitting part 211, an ejection passage 212, a center post 213, an ejection port 214, and a pressing part 215.

The actuator fitting part 220 has a cover 221 that forms an outer side surface of the actuator 200, and an engaging wall 224 formed inside of the cover 221. A hinge part 222 that connects the actuator operation part 210 and the actuator fitting part 220 is provided in an upper part of the cover 221. An arcuately protruding fitting convex portion 223 for connection with the container is formed in a lower part on an inner circumferential surface of the cover 221.

Vertically long, downwardly open slits 225 are provided in the engaging wall 224. A fitting convex portion 226 for connection with the fixing plate is formed to protrude in a circular arc shape from an inner circumferential surface of the engaging wall 224 except for the parts where the slits 225 are formed.

Figure 4:
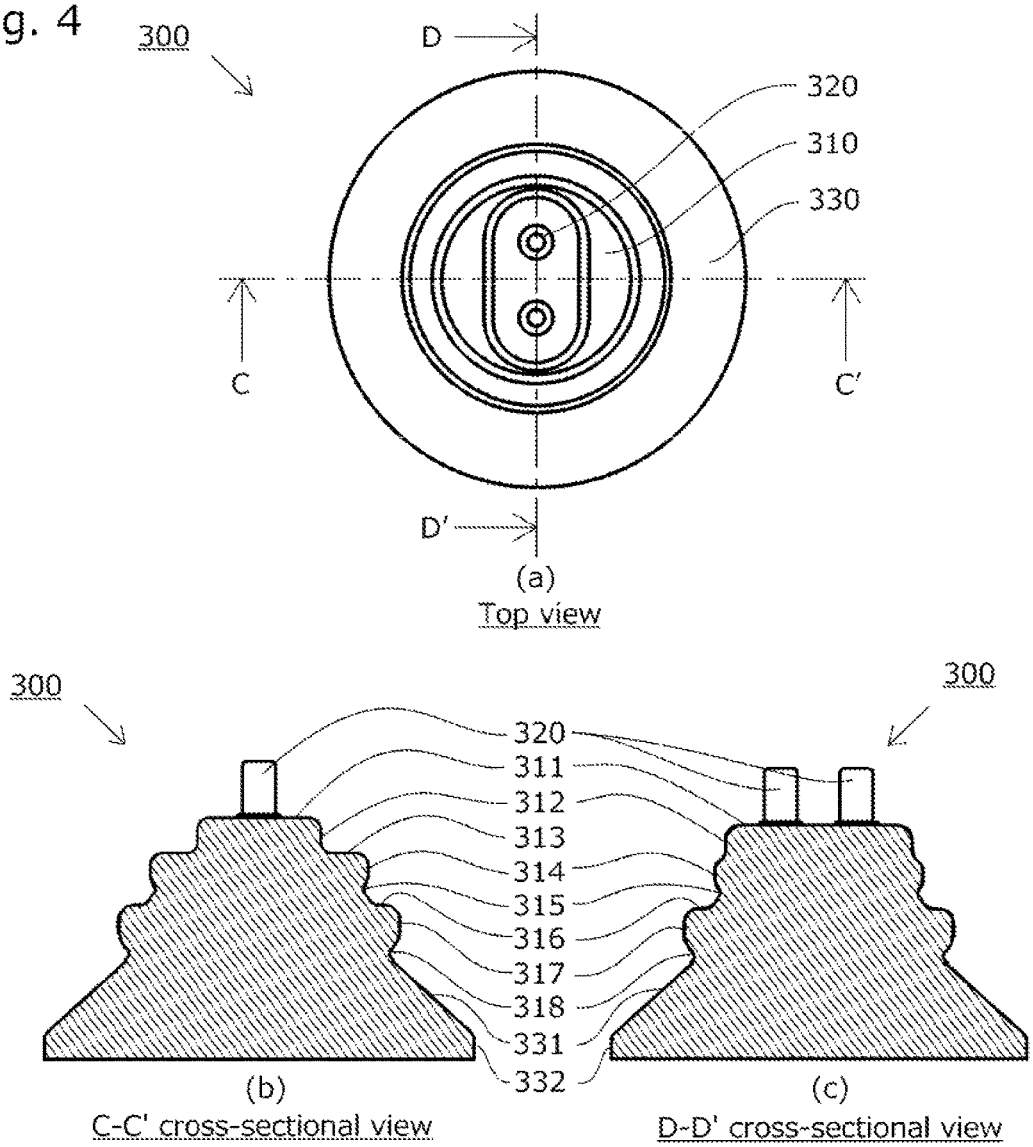
FIG. 4 shows a top view, a C-C' cross-sectional view, and a D-D' cross-sectional view of the aerosol container 300.
Figure 5:
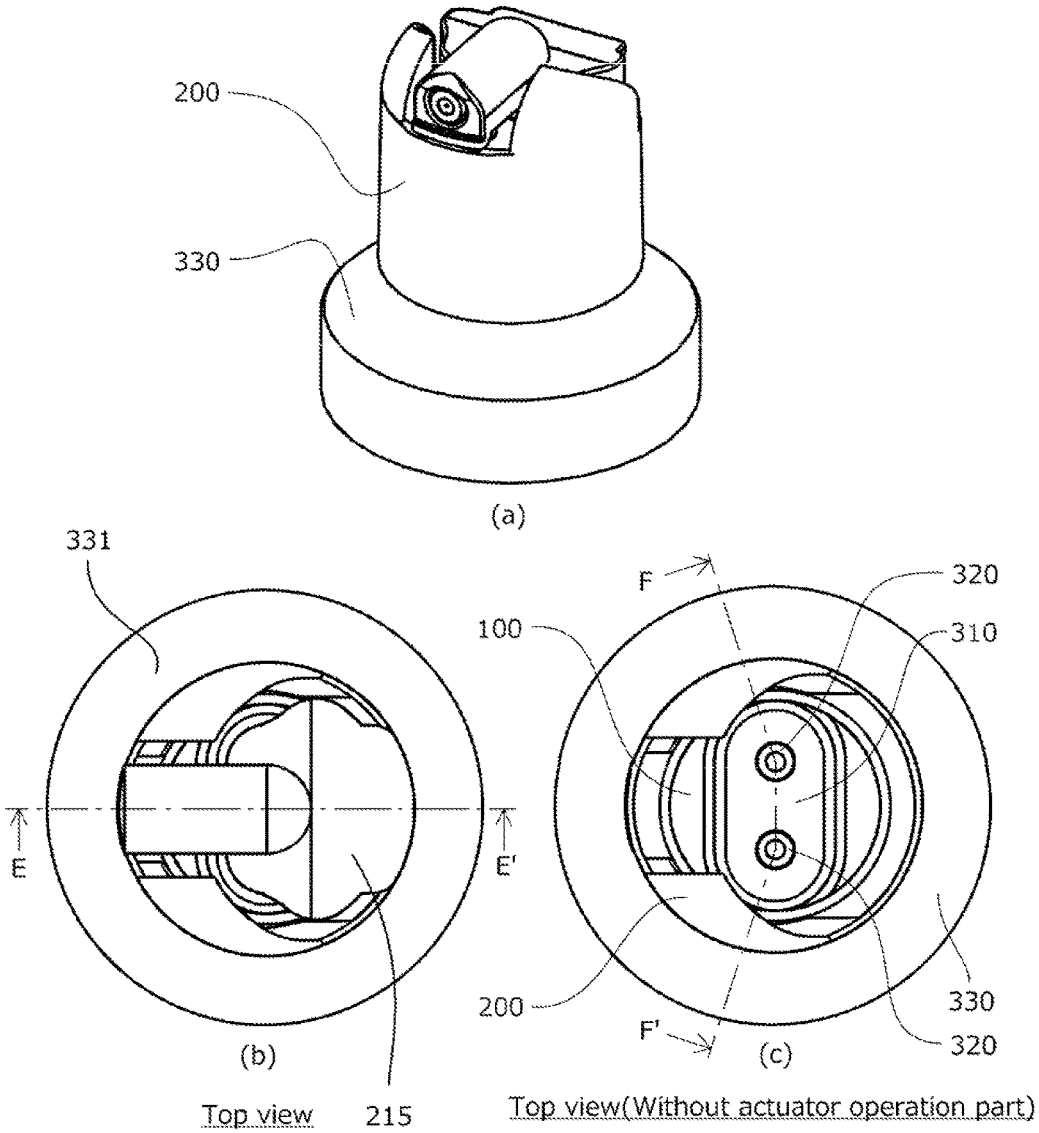
FIG. 5 shows a perspective view and a top view of the aerosol container 300 with the fixing plate 100 and actuator 200 fitted thereto, and a top view without an actuator operation part 210.

The aerosol container 300 is arranged such that the mounting cup 310 is fitted on an upper part of the aerosol can 330, with two stems 320 protruding from the upper part of the mounting cup 310, as shown in FIG. 1 and FIG. 4.

The mounting cup 310 has an upper step top surface 311 formed in an oval shape. An upper step side surface 312 extends down from the periphery of the upper step top surface 311 and connects to a middle step top surface 313.

The middle step top surface 313 has a disc shape with a larger outer diameter than that of the upper step top surface 311. A middle step side surface 314 extends down from the periphery of the middle step top surface 313 and connects to a lower step top surface 316. A middle step constricted portion 315 is formed below the middle step side surface 314.

The lower step top surface 316 has a disc shape with a larger outer diameter than that of the middle step top surface 313. A lower step side surface 317 extends down from the periphery of the lower step top surface 316 in conformity to and in tight contact with a shoulder part 331 of the aerosol can 330. A lower step constricted portion 318 is formed below the lower step side surface 317.

The shoulder part 331 is formed in a truncated conical shape so that its diameter increases downwards, and its lower end connects to a body part 332. The body part 332 is formed cylindrical and connected to a can bottom (not shown).

Next, the process steps of positioning and fitting the fixing plate 100 of this embodiment to the mounting cup 310 and of positioning and fitting the actuator 200 to the aerosol container 300 will be described with reference to FIG. 5 to FIG. 8. Note, only parts above the upper part of the body part 332 of the aerosol container 300 are shown.

First, the process of fitting the fixing plate 100 to the mounting cup 310 will be described. As shown in step 1, the fixing plate 100 is set above the aerosol container 300. The positioning wall 111 of the fixing plate 100 is oriented the same as the upper step side surface 312 of the mounting cup 310, and the fixing plate 100 is pressed onto the mounting cup 310. Since the positioning wall 111 is formed in conformity to the upper step side surface 312, the orientation of the fixing plate 100 is adjusted as it is fitted to the mounting cup 310 so that slight mismatches, if any, in the positions of the fixing plate 100 and mounting cup 310 are corrected. As the fixing plate 100 is pushed further, the retaining convex portions 112 fit into the middle step constricted portion 315, so that the fixing plate 100 can be maintained in the fitting state where it is retained to the mounting cup 310.

Figure 6:
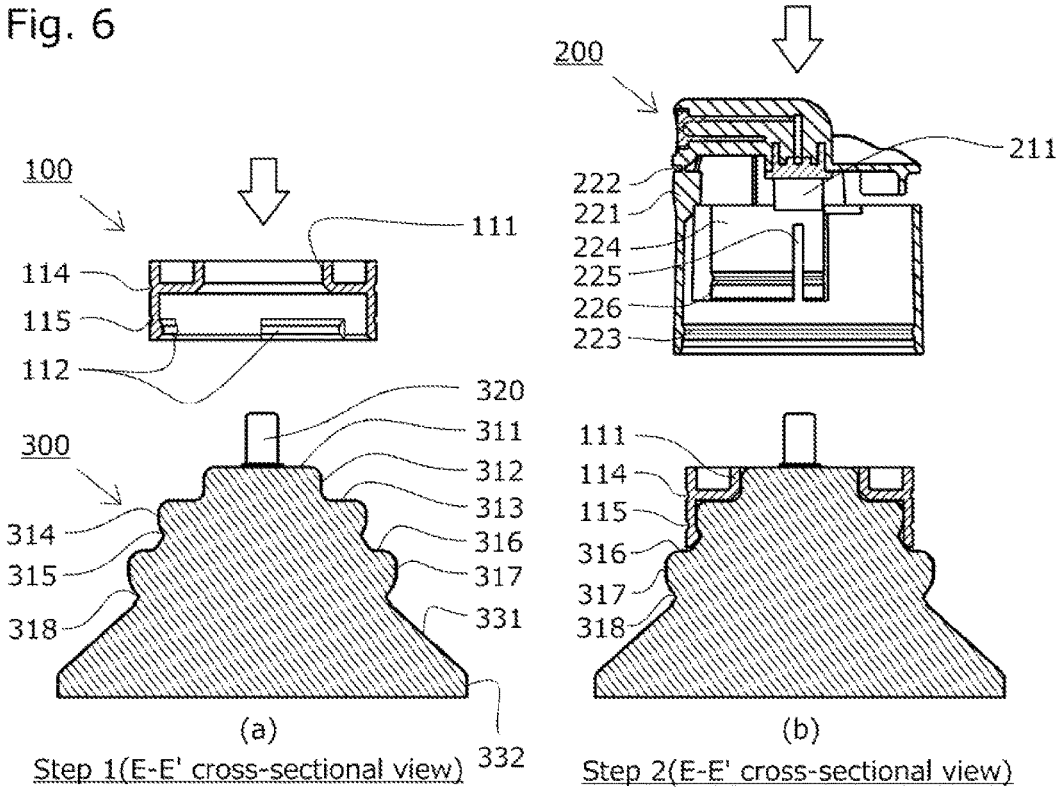
FIG. 6 shows an E-E' cross-sectional view of a fitting step (step 1) of the fixing plate 100, and a temporary fitting step (step 2) of the actuator 200.

Next, as shown in step 2 in FIG. 6, the actuator 200 is set above the aerosol container 300 with the fixing plate 100 fitted thereon, and the slits 225 of the actuator 200 are aligned with the anti-rotation ribs 113 of the fixing plate 100. After that, the actuator 200 is placed on the fixing plate, and pressed, while being adjusted to a position where the anti-rotation ribs 113 fit into the slits 225. The actuator 200 is pressed as far as to the position where the fitting convex portion 226 for connection with the fixing plate fits in the first constricted portion 114. This fitting state between the fixing plate 100 and the actuator 200 at this position shall be referred to as temporary fitting state.

Figure 7:
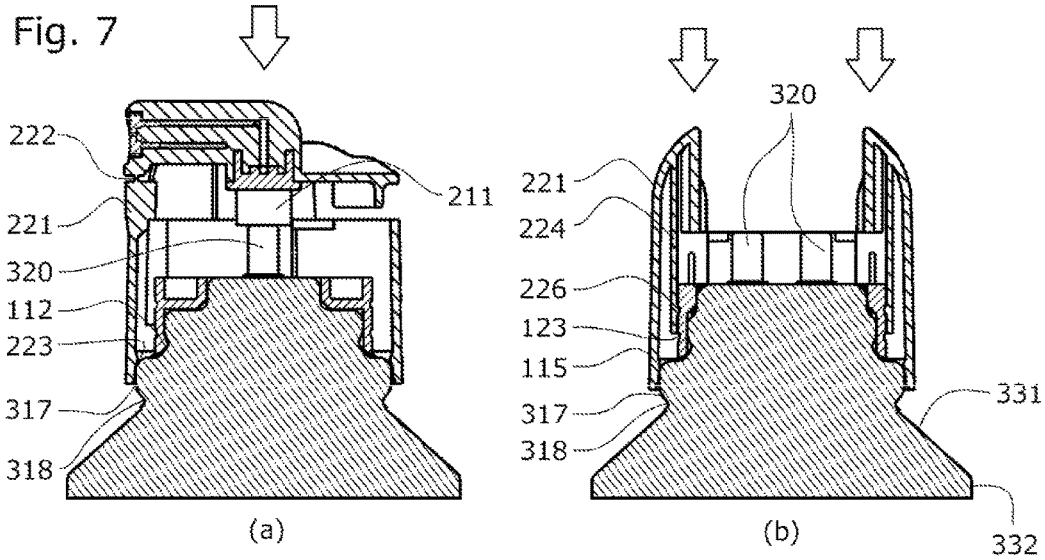
FIG. 7 shows an E-E' cross-sectional view and an F-F' cross-sectional view of a final fitting step (step 3) of the actuator 200.

In the temporary fitting state, as shown in FIG. 7, the fitting convex portion 226 for connection with the fixing plate fits in the first constricted portion 114, while the fitting convex portion 223 for connection with the container abuts on an upper part of the lower step side surface 317, so that the actuator 200 is prevented from coming off of the aerosol container 300 or displaced out of position during the assembly or transfer operation on a conveyor.

The positional relationship between the stem fitting part 211 and the stems 320 is adjusted in the temporary fitting state, so that the stem fitting part 211 and the stems 320 can be reliably fitted to each other without the risk of an edge of the stem fitting part 211 pushing the stems 320 further when the actuator 200 is pressed further.

Figure 8:
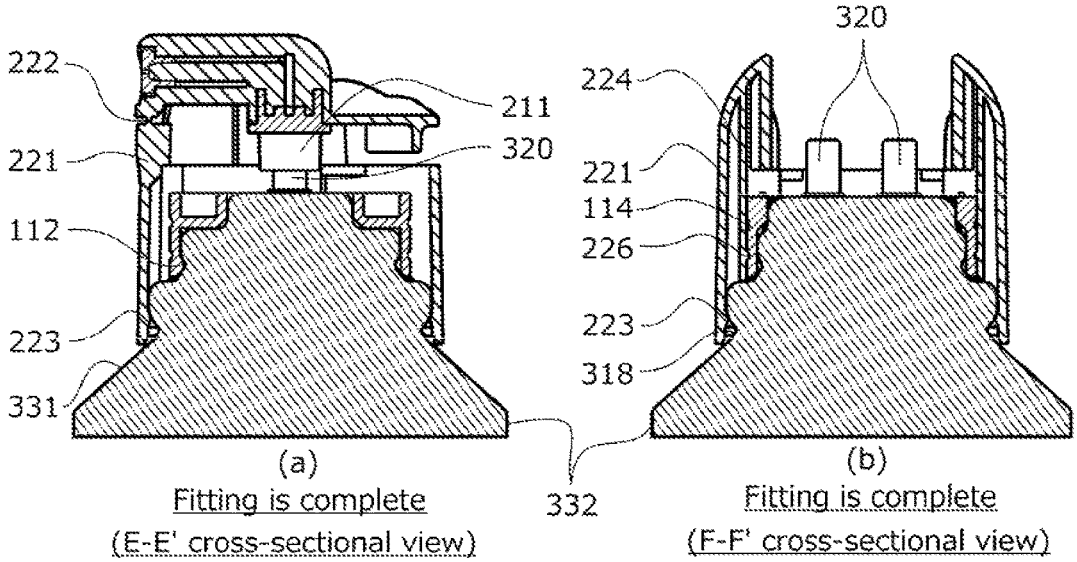
FIG. 8 shows an E-E' cross-sectional view and an F-F' cross-sectional view when fitting is complete.

After the positional relationship between various parts has been checked in the temporary fitting state, the actuator 200 is pushed down, which causes the fitting convex portion 226 for connection with the fixing plate to go over the first constricted portion 114 and to fit into the second constricted portion 115, and causes the fitting convex portion 223 for connection with the container to go over the lower step side surface 317 and to fit into the lower step constricted portion 318 as shown in FIG. 8, whereupon the fitting operation is complete.

At this time, the fixing plate 100 and actuator 200 are not in contact with the shoulder part 331 and body part 332 of the aerosol can 330. Thus the same fixing plate 100 or actuator 200 can be used irrespective of the shoulder shape or can body diameter of the aerosol can 330.

The fixing plate is also applicable to actuators 200 having a shape that fits only with the fixing plate 100, and thus actuators 200 smaller than the maximum diameter of the mounting cup 310 can also be used.

While one embodiment of the present invention has been described in detail, the present invention is not limited to the above-described embodiment and may be carried out with various design changes without departing from the scope of the present invention set forth in the claims.

While the actuator is fitted to the fixing plate in the embodiment described above, the component fitted to the fixing plate is not limited to this. For example, the cover that covers the periphery of the mounting cup, or a cap that covers the shoulder part and above of the aerosol container, may be fitted to the fixing plate.

While the cylindrical main body is provided with a first constricted portion and a second constricted portion on the outer circumferential surface in the embodiment described above, the number of constricted portions is not limited to two. For example, the entire outer circumferential surface below the upper part of the cylindrical main body may be radially set back, or three constricted portions may be provided.

While positioning is achieved by two slits of the actuator and two anti-rotation ribs of the fixing plate fitting to each other in the embodiment described above, the number and the shape of the slits and anti-rotation ribs are not limited to these. For example, three or more slits and anti-rotation ribs may be provided, or, the actuator may be provided with anti-rotation ribs, and the fixing plate may be provided with concave portions, and they may be fitted to each other.

While the retaining convex portion of the fixing plate fits in the middle step constricted portion to lock the fixing plate to the mounting cup in the embodiment described above, the method of locking the fixing plate is not limited to this. For example, the cylindrical main body may be press-fit to the middle step side surface of the mounting cup.

While the cylindrical main body is formed cylindrical in the embodiment described above, the shape of the cylindrical main body is not limited to this. For example, the cylindrical main body may be provided with downwardly open slits, or may be formed in a square tubular shape.

While the positioning wall is formed as high as the upper end of the cylindrical main body in the embodiment described above, the shape of the positioning wall is not limited to this. For example, the positioning wall may be formed higher than the upper end of the cylindrical main body, or may be formed to cover the mounting cup from the side surface to the upper top surface.

The invention claimed is:

1. A fixing plate for an aerosol container that is mounted to a mounting cup having an irregular-shaped upper step with two stems protruding therefrom and a cylindrical middle step, and is used for positioning of an exterior component, wherein the fixing plate is formed in a cylindrical shape fittable to the mounting cup, the fixing plate includes, on an inner circumferential side thereof, container positioning unit for engaging with a side surface of the upper step and determining a fitting position, and container lock unit for engaging with a portion below the cylindrical middle step to retain the fixing plate to the mounting cup, and the fixing plate includes, on an outer circumferential side thereof, exterior component positioning unit for engaging with an exterior component and determining a fitting position, and exterior component lock unit formed by a constricted portion for locking the exterior component.

2. The fixing plate for an aerosol container according to claim 1, wherein the fixing plate include, in an upper part on the inner circumferential side, a positioning wall in a shape conforming to a side surface of the upper step.

3. The fixing plate for an aerosol container according to claim 1, wherein the container lock unit includes a middle concave portion below the cylindrical middle step, and a retaining convex portion that is provided in a lower part on the inner circumferential side of the fixing plate and engages with the middle concave portion.

4. The fixing plate for an aerosol container according to claim 1, wherein the exterior component positioning unit is formed by a convex rib provided on the outer circumferential side of the fixing plate and extending vertically.

5. The fixing plate for an aerosol container according to claim 1, wherein the exterior component lock unit includes a plurality of fitting constricted portions for retaining and holding the exterior component at a fitting position.

6. The fixing plate for an aerosol container according to claim 1, wherein the fixing plate has an outermost diameter smaller than a maximum diameter of the mounting cup.

7. An aerosol product in which the fixing plate for an aerosol container according to claim 1 is mounted to a mounting cup, wherein an exterior component engages with the fixing plate and fits with a portion below the mounting cup.

* * * * *